US010683750B2

(12) United States Patent
Couchoud et al.

(10) Patent No.: US 10,683,750 B2
(45) Date of Patent: Jun. 16, 2020

(54) APPARATUS AND METHOD FOR DRIVING A CAVITY IN MINING

(71) Applicant: HERRENKNECHT AKTIENGESELLSCHAFT, Schwanau (DE)

(72) Inventors: Timothée Couchoud, Schwanau (DE); Thomas Joseph Edelmann, Bühl (DE); Patrick Michael Rennkamp, Lahr im Schwarzwald (DE); Frédéric Robert Cousseau, Weyersheim (FR)

(73) Assignee: HERRENKNECHT AKTIENGESELLSCHAFT, Schwanau (DE)

( * ) Notice: Subject to any disclaimer, the term of this patent is extended or adjusted under 35 U.S.C. 154(b) by 0 days.

(21) Appl. No.: 15/778,537

(22) PCT Filed: Dec. 5, 2016

(86) PCT No.: PCT/EP2016/079712
§ 371 (c)(1),
(2) Date: May 23, 2018

(87) PCT Pub. No.: WO2017/097692
PCT Pub. Date: Jun. 15, 2017

(65) Prior Publication Data

US 2018/0347356 A1 Dec. 6, 2018

(30) Foreign Application Priority Data

Dec. 8, 2015 (DE) ..... 10 2015 121 312

(51) Int. Cl.
*E21D 9/11* (2006.01)
*E21B 10/10* (2006.01)
(Continued)

(52) U.S. Cl.
CPC ..... *E21C 27/22* (2013.01); *E21B 4/18* (2013.01); *E21B 7/28* (2013.01); *E21D 9/1006* (2013.01);
(Continued)

(58) Field of Classification Search
CPC ..... E21D 9/10; E21D 9/1006; E21D 9/104; E21D 9/11; E21D 9/111; E21D 9/112;
(Continued)

(56) References Cited

U.S. PATENT DOCUMENTS 1,333,491 A * 3/1920 Hughes ..... E21D 9/10 299/31
2,325,459 A * 7/1943 Zublin ..... E21B 10/08 175/338
(Continued)

FOREIGN PATENT DOCUMENTS

DE 26 23 135 12/1977
DE 28 48 349 2/1980
(Continued)

OTHER PUBLICATIONS

International Search Report dated Mar. 14, 2017 in PCT/EP2016/079712.
(Continued)

*Primary Examiner* — Janine M Kreck
*Assistant Examiner* — Michael A Goodwin
(74) *Attorney, Agent, or Firm* — Faegre Drinker Biddle & Reath LLP

(57) ABSTRACT

A device for advancing a cavity in underground mining, including a rotary drive, an axial shaft that is rotatable together with the rotary drive about a longitudinal axis, exactly one extraction drum that is rotatable about an drum rotational axis, and a connecting arrangement which is connected to the axial shaft and which supports the extrac-
(Continued)

tion drum, the connecting arrangement being configured in such a way that the drum rotational axis and the longitudinal axis lie in a plane, and are oriented at an acute angle with respect to one another in the advancing direction, in all operating positions during the advancement, characterized in that the extraction drum extends over at least an effective radius of the device in the radial direction of the device during advancement of the cavity.

20 Claims, 6 Drawing Sheets

(51) Int. Cl.

| | |
|---|---|
| ***E21C 27/22*** | (2006.01) |
| ***E21B 4/18*** | (2006.01) |
| ***E21B 7/28*** | (2006.01) |
| ***E21D 9/10*** | (2006.01) |

(52) U.S. Cl.
CPC ..... *E21D 9/112* (2013.01); *E21B 10/10* (2013.01); *E21D 9/116* (2013.01)

(58) Field of Classification Search
CPC ..... E21D 9/113; E21D 9/116; E21D 9/117; E21D 9/118; E21B 10/10
See application file for complete search history.

(56) References Cited

U.S. PATENT DOCUMENTS

| | | | | |
|---|---|---|---|---|
| 2,758,825 | A * | 8/1956 | Wohlmeyer | E21D 9/1086 299/1.3 |
| 2,758,826 | A * | 8/1956 | Paget | E21C 27/24 299/78 |
| RE25,470 | E * | 11/1963 | Allimann | E21D 9/11 299/56 |
| 3,510,170 | A * | 5/1970 | Wilms | E21D 9/1086 299/33 |
| 4,486,050 | A * | 12/1984 | Snyder | E21D 9/11 175/91 |
| 4,832,143 | A * | 5/1989 | Kaalstad | E21B 10/12 175/365 |
| 5,192,116 | A | 3/1993 | Turner et al. | |
| 2010/0314931 | A1 * | 12/2010 | Ebner | E21D 9/1006 299/33 |
| 2011/0198914 | A1 * | 8/2011 | Hartwig | E21C 27/24 299/18 |
| 2015/0152728 | A1 * | 6/2015 | Hartwig | E21C 27/24 299/10 |

FOREIGN PATENT DOCUMENTS

| | | | | |
|---|---|---|---|---|
| DE | 28 48 348 | | 5/1980 | |
| WO | WO-2007075149 | A1 * | 7/2007 | E21D 9/118 |

OTHER PUBLICATIONS

International Written Opinion dated Mar. 14, 2017 in PCT/EP2016/079712.

* cited by examiner

APPARATUS AND METHOD FOR DRIVING A CAVITY IN MINING

CROSS-REFERENCE TO RELATED APPLICATIONS

This application is a U.S. National Phase Patent Application based on International Application No. PCT/EP2016/079712 filed Dec. 5, 2016, which claims priority to German Patent No. 10 2015 121 312.5 filed Dec. 8, 2015, the entire discloses of which are hereby explicitly incorporated by reference herein.

BACKGROUND OF THE INVENTION

1. Field of Invention

The present invention relates to a device for advancing a cavity in underground mining. The invention further relates to a method for advancing a cavity in underground mining.

2. Description of the Related Art

One device and method for advancing a cavity in underground mining is disclosed in DE 28 48 349 B1. This previously known device for advancing a cavity in underground mining has a rotary drive, and an axial shaft that is rotatable together with the rotary drive about a longitudinal axis. In addition, an extraction drum that is rotatable about a drum rotational axis is present. A connecting arrangement connected to the axial shaft is used for supporting the extraction drum, the connecting arrangement being configured in such a way that the drum rotational axis and the longitudinal axes lie in a plane, and are oriented at an acute angle with respect to one another in the advancing direction, in all operating positions during the advancement. Furthermore, in addition to the extraction drum, which extends over a portion of an effective radius of the device as a means for extracting excavation material at the working face, the generic device also has a central drill head, oriented in the axial direction and about which the extraction drum rotates, as a further means for extracting excavation material at the working face.

Another device for advancing a cavity in underground mining is known from DE 26 23 135 A1, having two extraction drums that are oriented at an acute angle with respect to a longitudinal axis, each extending over a partial section of an effective radius of the device, and being provided about a guide core in order to extract excavation material.

A further device and a further method for advancing a cavity in underground mining are known from U.S. Pat. No. 5,192,116. The previously known device for advancing a cavity in underground mining has a rotary drive unit, and an axial shaft which together with the rotary drive unit is rotatable about a longitudinal axis. In addition, an extraction drum that is rotatable about a drum rotational axis is present. A connecting arrangement connected to the axial shaft is used for supporting the extraction drum, and is provided with displacement units for moving the extraction drum, whose drum rotational axis is oriented at right angles to the longitudinal axis, in a vertical direction. With regard to a preferably high degree of flexibility when carrying out the movements about multiple axis in the longitudinal direction of the drum rotational axis, the extraction drum is equipped with only one sequence of roller cutters situated in the circumferential direction.

SUMMARY OF THE INVENTION

The present invention provides a device and a method for advancing a cavity in underground mining, which includes a high advancement rate and having a design that is relatively mechanically simple, compact, and robust.

As the result of the device according to the invention and the method according to the invention having an appropriate design of the extraction drum with its extension over at least the effective radius of the device while advancing the cavity, as well as the connecting arrangement, the drum rotational axis, and the longitudinal axis lying in a plane and being oriented at an acute angle with respect to one another in all operating positions during the advancement, the extraction drum may have relatively large dimensions in the direction of the drum rotational axis and may be connected to the axial shaft in a mechanically simple and stable manner, with a relatively short overall length of the device in the direction of the longitudinal axis, with corresponding flexibility during use under confined conditions. Due to the direct coupling of the extraction drum to the axial shaft, with clearance from other mechanically vulnerable elements, a relatively simple and mechanically stable design is achieved, which, for example, allows high contact pressure forces of the extraction drum at the working face, and with a relatively large area of action of the extraction drum results in relatively high advancement rates during individual advancement cycles on the working face.

In one form thereof, the present invention proves a device for advancing a cavity in underground mining, including a rotary drive, an axial shaft that is rotatable together with the rotary driveabout a longitudinal axis, exactly one extraction drum that is rotatable about a drum rotational axis, and a connecting arrangement which is connected to the axial shaft and which supports the extraction drum, the connecting arrangement being configured in such a way that the drum rotational axis and the longitudinal axis lie in a plane, and are oriented at an acute angle with respect to one another in the advancing direction, in all operating positions during the advancement, characterized in that the extraction drum extends over at least an effective radius of the device in the radial direction of the device during advancement of the cavity.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
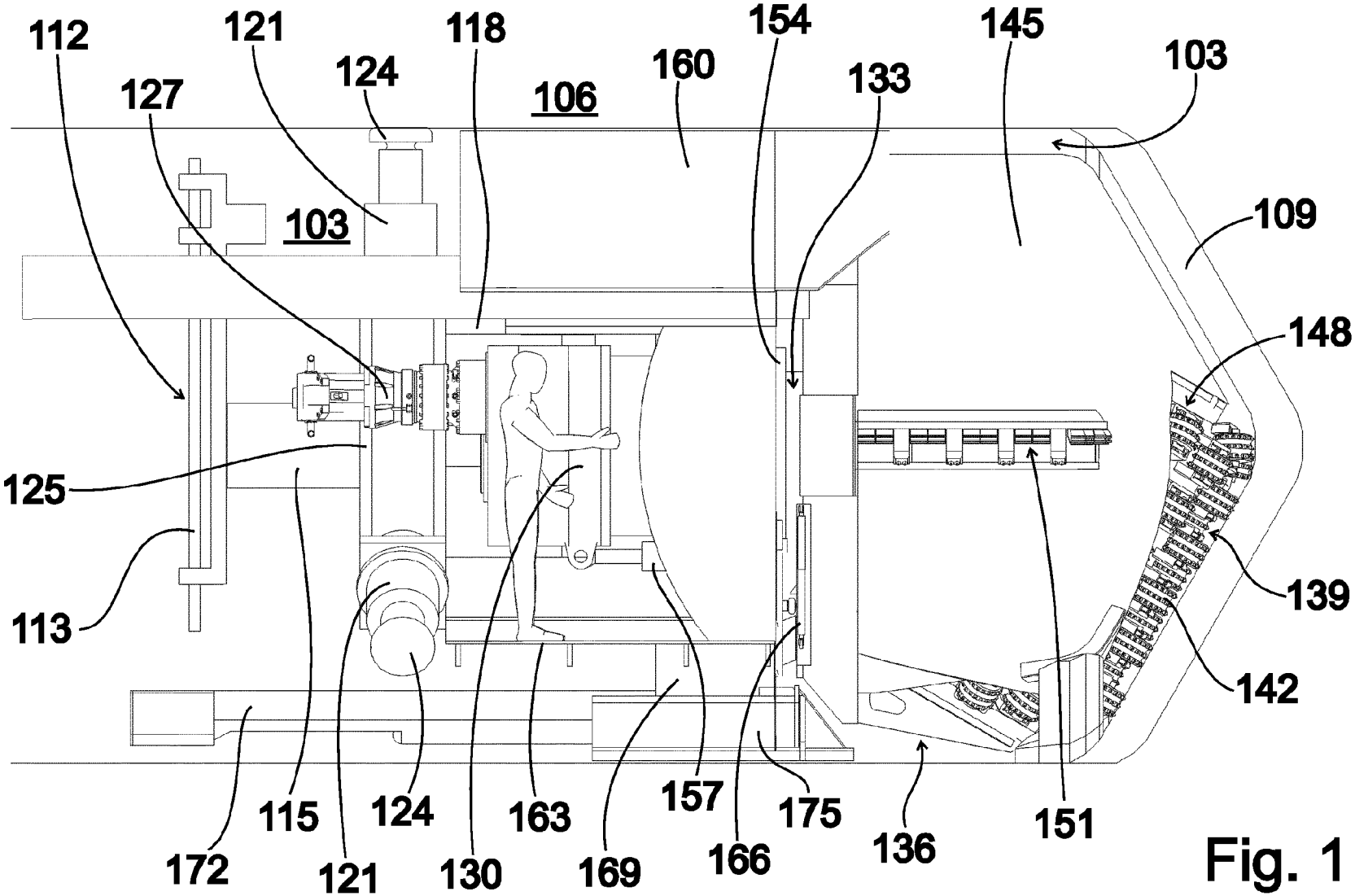
FIG. 1 is a side view of one exemplary embodiment of a device according to the invention, with an extraction drum in a starting position.

Corresponding reference characters indicate corresponding parts throughout the several views. Although the exemplifications set out herein illustrate embodiments of the invention, the embodiments disclosed below are not intended to be exhaustive or to be construed as limiting the scope of the invention to the precise forms disclosed.

DETAILED DESCRIPTION

FIG. 1 shows a side view of one exemplary embodiment of a device according to the invention for advancing a cavity 103 into bedrock 106 surrounding the cavity 103 in underground mining. In the illustration according to FIG. 1, the cavity 103 is designed as a horizontally extending section that is delimited at one end by a working face 109.

The exemplary embodiment according to FIG. 1 has a drilling unit 112, which during proper use is disposed at a side facing away from a working face 109, and which includes drilling anchors 113 that may be placed in the bedrock 106 in radially outward directions. The drilling unit 112 is mounted on a machine frame 118 via a drill carrier unit 115. The machine frame 118 supports the drilling unit 112 in the direction of the working face 109, opposite from a number of bracing cylinders 121 oriented in the radial direction, with which tiltably supported pressing plates 124 are pressable against the wall of the cavity 103. The bracing cylinders 121 are mounted on a bracing cylinder support 125.

In addition, the machine frame 118 in the illustrated exemplary embodiment of a device according to the invention bears a central drive unit 127 to which a rotary drive 130 is coupled, and via the rotary drive an axial shaft 133 is drivable about a longitudinal axis, oriented in an advancement direction, for rotation in two rotational directions. The axial shaft 133 in turn is rotatably fixedly coupled via a connecting arrangement 136 to a single extraction drum 139, which in the illustration according to FIG. 1 rests against the working face 109, and which on the outer side is equipped with a plurality of cutting rollers 142 as excavation tools, and which is present on the working face 109 as the sole means for extracting excavation material.

The exemplary embodiment according to FIG. 1 has a number of protective plates 145 which cover the region of the cavity 103 near the working face, at a relatively small distance from the wall of the cavity 103, and a recess 148 for a portion of the extraction drum 139 that protrudes in the direction of the longitudinal axis. A conveying opening 151 is formed in each case between two pairs of protective plates 145 that adjoin one another in the circumferential direction.

For advancement of the cavity 103 with extraction of excavation material from the area of the working face 109, a feed unit 154 having a number of feed cylinders 157 connected to the machine frame 118 is present for pressing the exactly one extraction drum 139 against the working face 109.

It is also apparent from the illustration according to FIG. 1 that, in particular for protecting operators, the illustrated exemplary embodiment has a number of cover plates 160 that are situated on the side of the protective plates 145 facing away from the extraction drum 139, and that advantageously extend at least to the vicinity of the bracing cylinders 121. In addition, at least one walkway 163 is advantageously mounted on the machine frame 118, which is useful for operators in particular so that when the extraction drum 139 is in the appropriate position in the area of a closing slide 166, as an example of the design of a closure in an ejection position of the extraction drum 139, illustrated in FIG. 1, an ejection chute 169 situated at the closing slide 166, on the side opposite from the extraction drum 139, may be reached.

On the side of the ejection chute 169 facing away from the extraction drum 139, the exemplary embodiment according to FIG. 1 has a discharge belt 172 as an example of the design of a discharging device for discharging in the ejection position illustrated in FIG. 1, with the closing slide 166 situated at a low point, and after the closing slide is opened, excavation material being output via the ejection chute 169. It is also illustrated in FIG. 1 that the exemplary embodiment has a bearing unit 175 which is fixedly connected to the machine frame 118, and which as needed, and in particular during initial installation of the device, rests on the base of the cavity 103 for an advancement.

Figure 2:
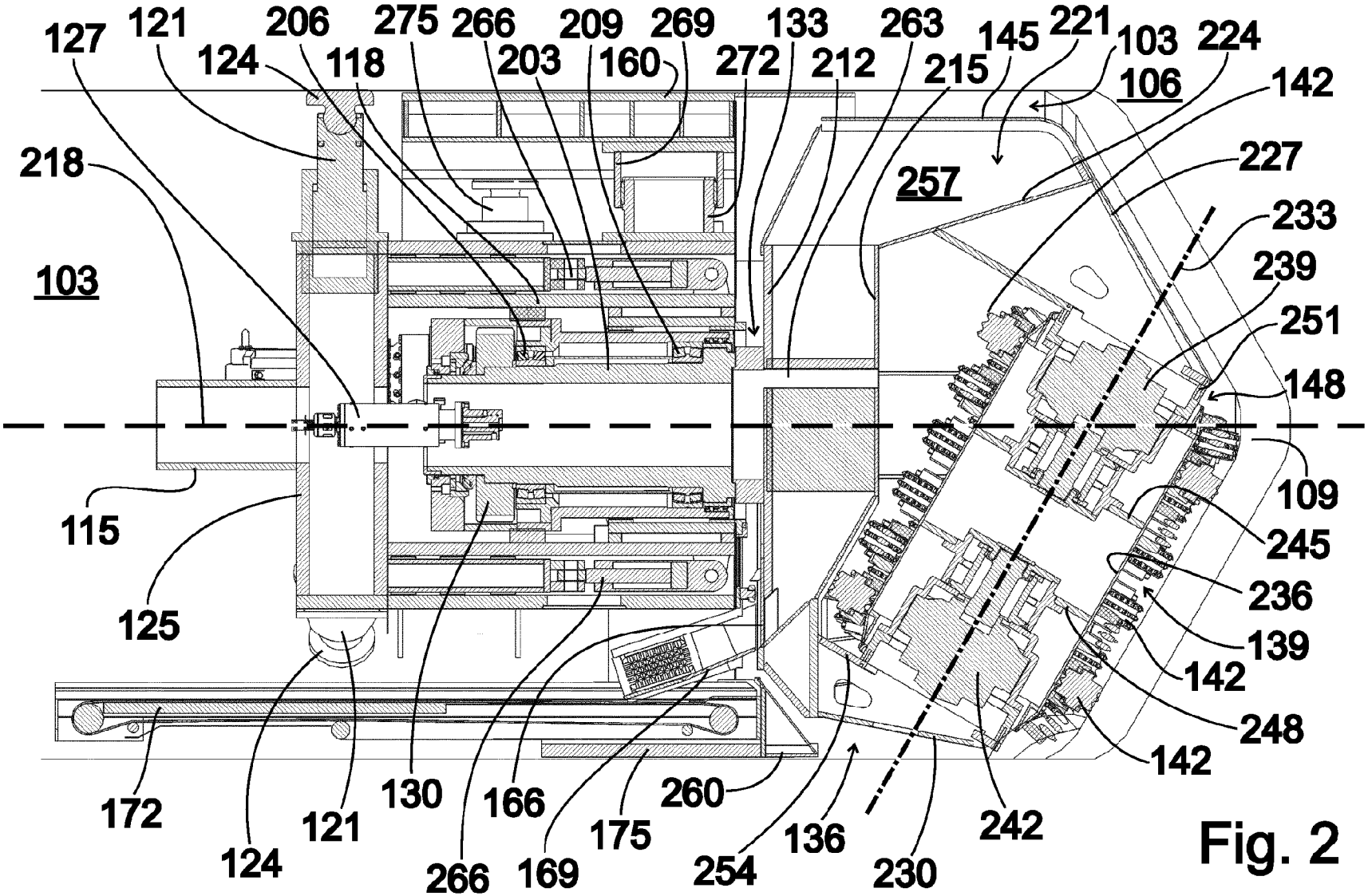
FIG. 2 is a sectional view of the exemplary embodiment according to FIG. 1 in the longitudinal direction.

FIG. 2 shows a longitudinal section of the exemplary embodiment according to FIG. 1, wherein in addition to FIG. 1, it is apparent from FIG. 2 that the axial shaft 133 with a bearing section 203 is rotatably supported on the machine frame 118 via a number of bearing rings 206, 209. On the side of the bearing section 203 facing the extraction drum 139, the axial shaft 133 is provided with a hollow cylindrical spacer 212, which on its side facing the extraction drum 139 is connected to the connecting arrangement 136.

In the illustrated exemplary embodiment, the connecting arrangement 136 is designed with a connecting arm 215 which is connected to the spacer 212 and which extends diagonally on both sides of the longitudinal axis 218, illustrated in dashed lines in FIG. 2, and about which the axial shaft 133 is rotatable in the two rotational directions in order to compensate for rolling of the device about the longitudinal axis 218. Attached to one end of the connecting arm 215 is a long drum retaining arm 221, which has a cross member 224 oriented at right angles to the connecting arm 215 and extending away from the machine frame 118 in parallel to the longitudinal axis 218, and which has an end member 227 that is attached to the end of the cross member 224 facing away from the connecting arm 215 and is inclined at an angle in the direction of the longitudinal axis 218.

In addition, the connecting arrangement 136 has a short drum retaining arm 230, designed as one piece, which is mounted on the end of the connecting arm 215 oppositely situated from the long drum retaining arm 221, and which extends away from the machine frame 118.

The drum retaining arms 221, 230 of the connecting arrangement 136 are designed in such a way that the extraction drum 139 with its drum rotational axis 233, illustrated in dash-dotted lines in FIG. 2, is inclined at an acute angle with respect to the longitudinal axis 218, and intersects the longitudinal axis 218 due to an extension, over at least one effective radius of the device according to the invention, in the radial direction of the device. As a result, when the axial shaft 133 rotates about the longitudinal axis 218, the drum rotational axis 233 runs on a conical surface whose tip faces away from the machine frame 118.

It is also apparent from the illustration according to FIG. 2 that the extraction drum 139 has a hollow cylindrical drum body 236 whose extension along the drum rotational axis 233 is preferably longer than the effective radius of the device according to the invention during advancement. This ensures that the cutting rollers 142 mounted on the outer side of the drum body 236 are active over at least one-half the diameter of a working face 109 in the radial direction with respect to the longitudinal axis 218.

The extraction drum 139 is advantageously automatically drivable to rotation about the drum rotational axis 233 via a drum rotary drive unit, which in the illustrated exemplary embodiment has two drum rotary drive motors 239, 242, and which is advantageously coupled to the central drive unit 127. The drum rotary drive motors 239, 242 are supported on the one hand on the long drum retaining arm 221 and the short drum retaining arm 230, respectively, and on the other hand, on reinforcing plates 245, 248 formed in the drum body 236 and reinforcing collars 251, 254 resting at the end of the drum body 236.

Furthermore, it is apparent from the illustration according to FIG. 2 that in the drum retaining arms 221, 230 and in the connecting arm 215, an excavation material receiving space 257 is formed which is open toward the conveying openings 151, illustrated in FIG. 1 but not visible in FIG. 2, and open toward a side facing away from the extraction drum 139, and which is closable on this side via the closing slide 166. When the extraction drum 139 rotates about the longitudinal axis 218 and about the drum rotational axis 233, excavation material that is discharged from a working face 109 thus passes into the excavation material receiving space 257, and may be output via the ejection chute 169 onto the discharge belt 172 when the closing slide 166 is situated in the area of the ejection chute 169, after the closing slide 166 is opened. Guide plates 260 are advantageously provided for efficient filling of the excavation material receiving space 257.

It is also apparent from the illustration according to FIG. 2 that a pass-through channel 263 is formed in the connecting arm 215, through which, for example, hydraulic lines, not illustrated in FIG. 2, for driving hydraulically operating drum rotary drive motors 239, 242 may be passed through.

It is also apparent from FIG. 2 that coupled to the bracing cylinder support 125 are make-up cylinders 266, which in turn are connected to the machine frame 118, and via which the bracing cylinder support 125 is movable in the axial direction relative to the machine frame 118.

Also apparent in FIG. 2 are interlocking articulated sleeves 269, 272 which are oriented in the radial direction and situated between the machine frame 118 and a cover plate 160 situated on the cover side, and which are rotatable relative to one another in order to form a rotary joint. In this way, the machine frame 118 may be rotated, within certain limits, at right angles to the longitudinal axis 218 relative to the cover plate 160 situated on the cover side.

The cover plates 160 in turn are movable in the radial direction relative to the machine frame 118 via a pressing cylinder 275 in each case, so that, together with the bracing cylinders 121, they are used for bracing the illustrated exemplary embodiment of a device according to the invention.

Figure 3:
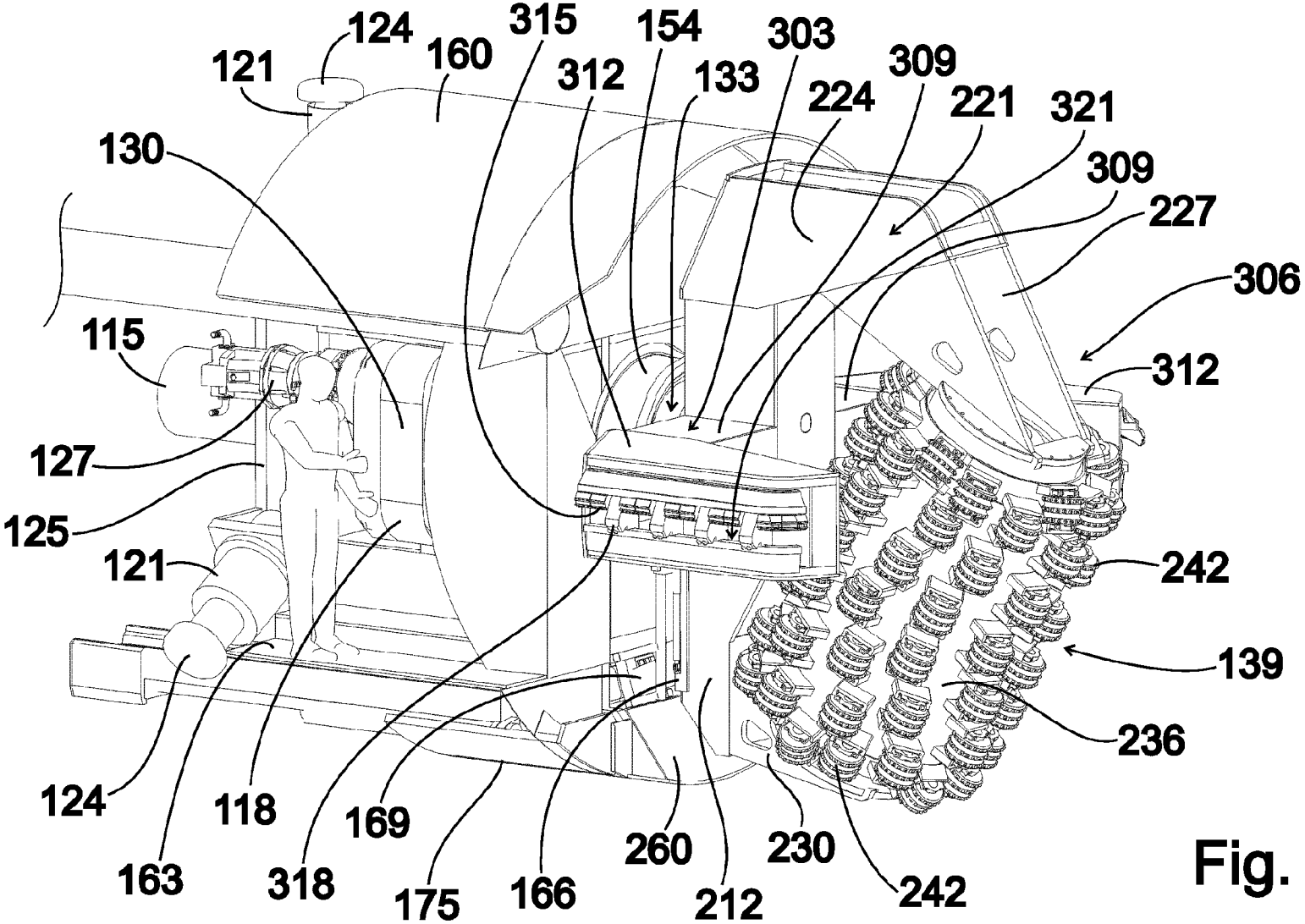
FIG. 3 is a perspective view of the exemplary embodiment according to FIG. 1, with a view of the side facing a working face during advancement.

FIG. 3 shows a perspective view of the exemplary embodiment according to FIG. 1 with the protective plates 145 removed, and with a view of the extraction drum 139 on the side facing a working face 109 in the advancement direction. It is apparent from the illustration according to FIG. 3 that two support arms 303, 306 are mounted on the connecting arm 215, each having a radial section 309 extending at right angles to the longitudinal axis 218, and having a jaw section 312 extending from the radial section 309, away from the machine frame 118. The support arms 303, 306 are used in addition to the drum retaining arms 221, 230 for fastening the protective plates 145, not illustrated in FIG. 3.

The support arms 303, 306 are advantageously equipped with radially outwardly protruding, shovel-like reamer tools 315, and with likewise radially outwardly protruding crusher tools 318, which are situated on the edge of radially outwardly formed conveying cutouts 321 in the support arms 303, 306, in order to crush discharged excavation material with good power transmission and to transfer it, via the conveying cutouts 321 situated on the radially inner side of the conveying openings 151 illustrated in FIG. 1, into the excavation material receiving space 257. The drum retaining arms 221, 230, in contrast, are radially outwardly closed.

Figure 4:
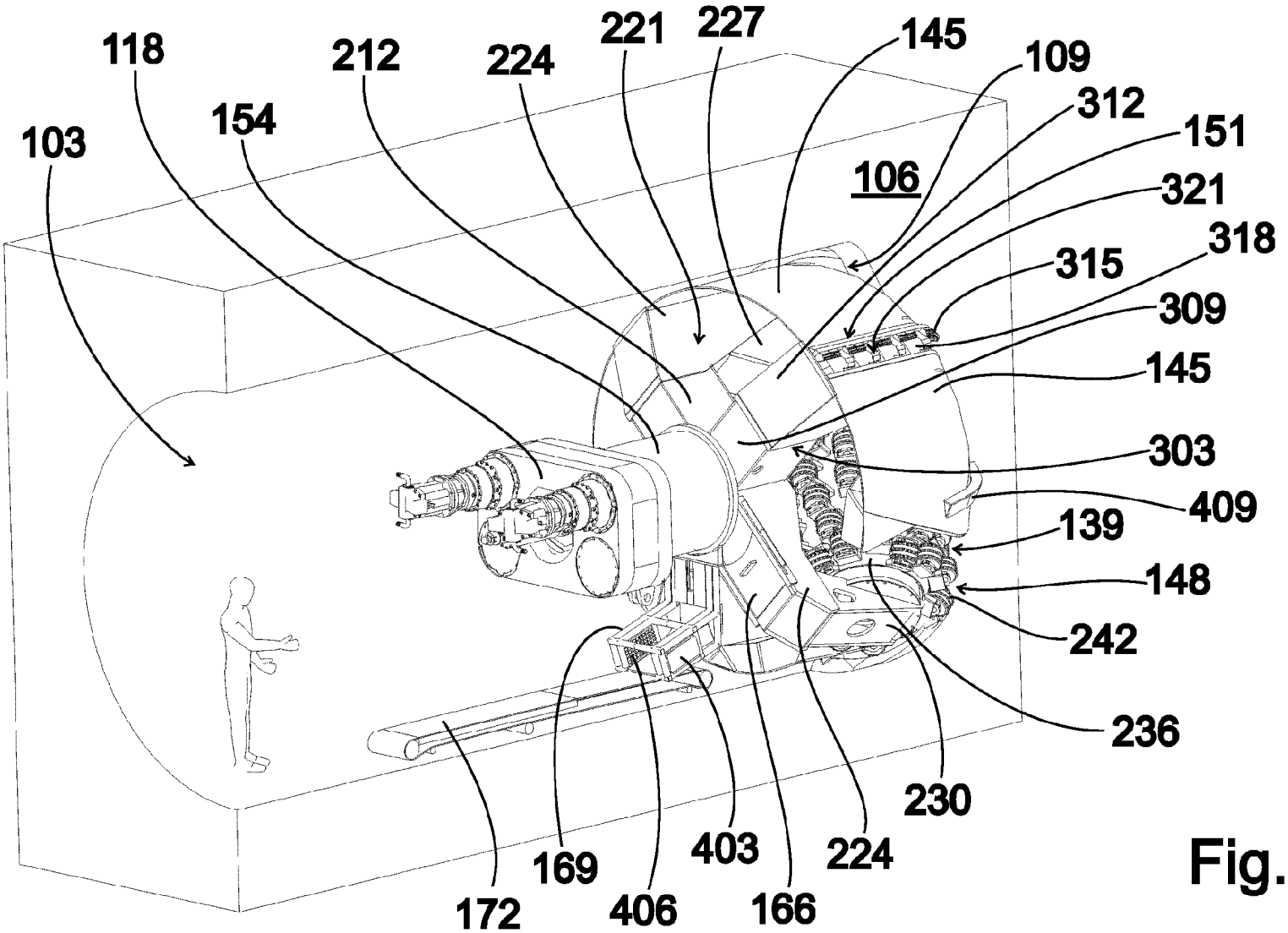
FIG. 4 is a perspective view of the exemplary embodiment according to FIG. 1 during advancement, with a view of the side facing away from a working face.

FIG. 4 shows a perspective view of the exemplary embodiment according to FIG. 1 with a view of the side facing away from the extraction drum 139, wherein a number of elements explained with reference to FIGS. 1 through 3 are not shown in the illustration according to FIG. 4 for improved clarity. The illustration according to FIG. 4 clearly shows the cross-like design of the connecting arrangement 136 with the drum retaining arms 221, 230 and support arms 303, 306 oriented at right angles to one another, which result in high rigidity of the connecting arrangement 136 in the area of the extraction drum 139.

It is also apparent in the illustration according to FIG. 4 that oppositely situated crusher jaws 403, 406 that are movable toward one another for crushing ejected excavation material are situated in the area of the ejection chute 169.

It is also illustrated in FIG. 4 that the protective plates 145 essentially completely cover the area around the extraction drum 139 in the circumferential direction up to the section in which the extraction drum 139 protrudes beyond the recess 148, and up to the conveying cutouts 321. Wiper tools 409 are present on the end-face side, pointing in the direction of the working face 109.

Figure 5:
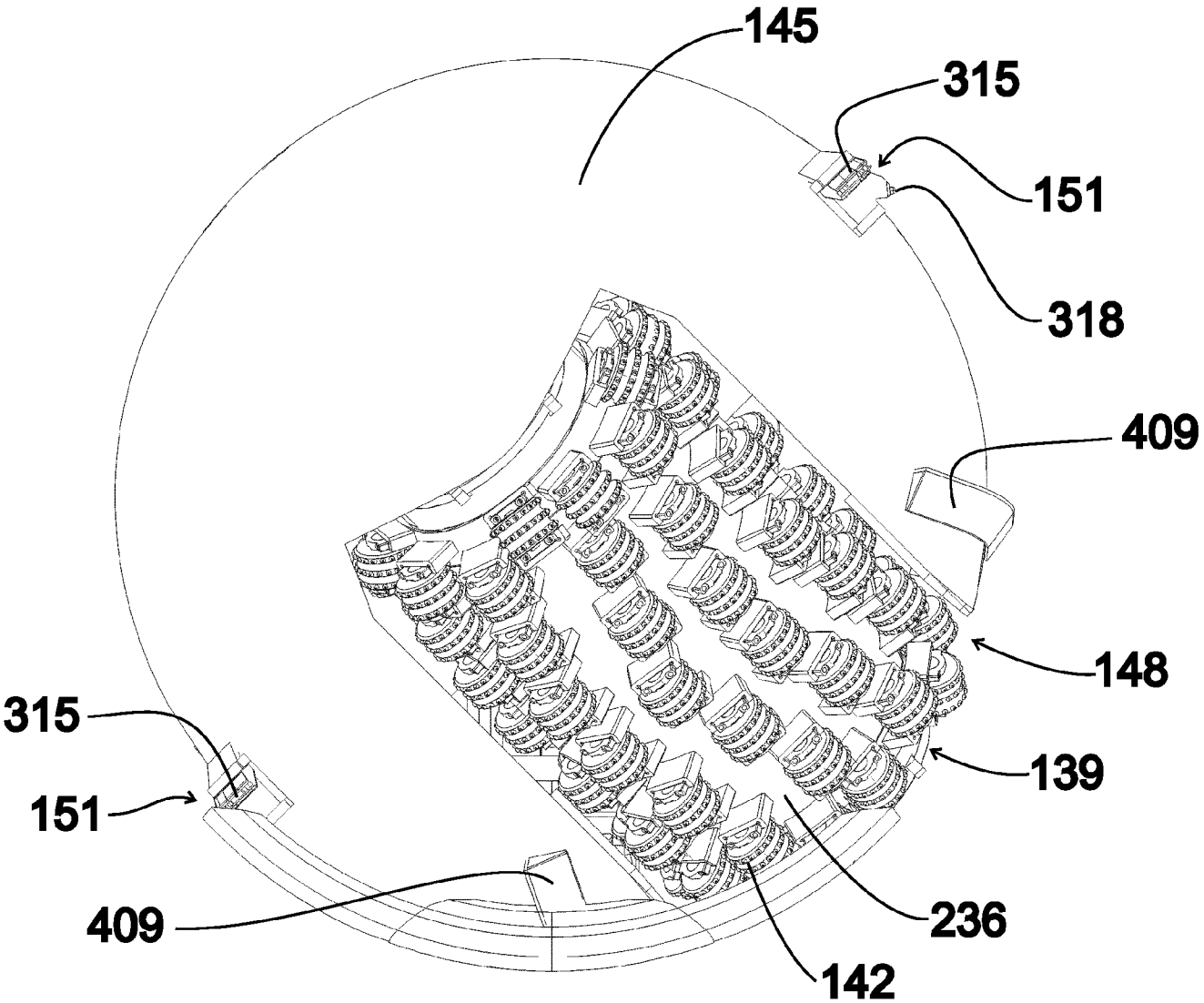
FIG. 5 is an exemplary embodiment according to FIG. 1, in an end-face view of the side facing a working face during advancement.

FIG. 5 shows the exemplary embodiment according to FIG. 1 in an end-face view of the extraction drum 139. It is apparent from FIG. 5 that the extraction drum 139 protrudes in the axial direction in a section of a cylindrical cover surface spanned by the protective plates 145, in order to remove excavation material in the area of a working face 109 by the action of the cutting rollers 142. It is also apparent in the illustration according to FIG. 5 that the wiper tools 409 are designed with different beveling for effective use in two rotational directions about the longitudinal axis 218 for conveying into a conveying opening 151 in each case during rotation in one of the two rotational directions.

Figure 6:
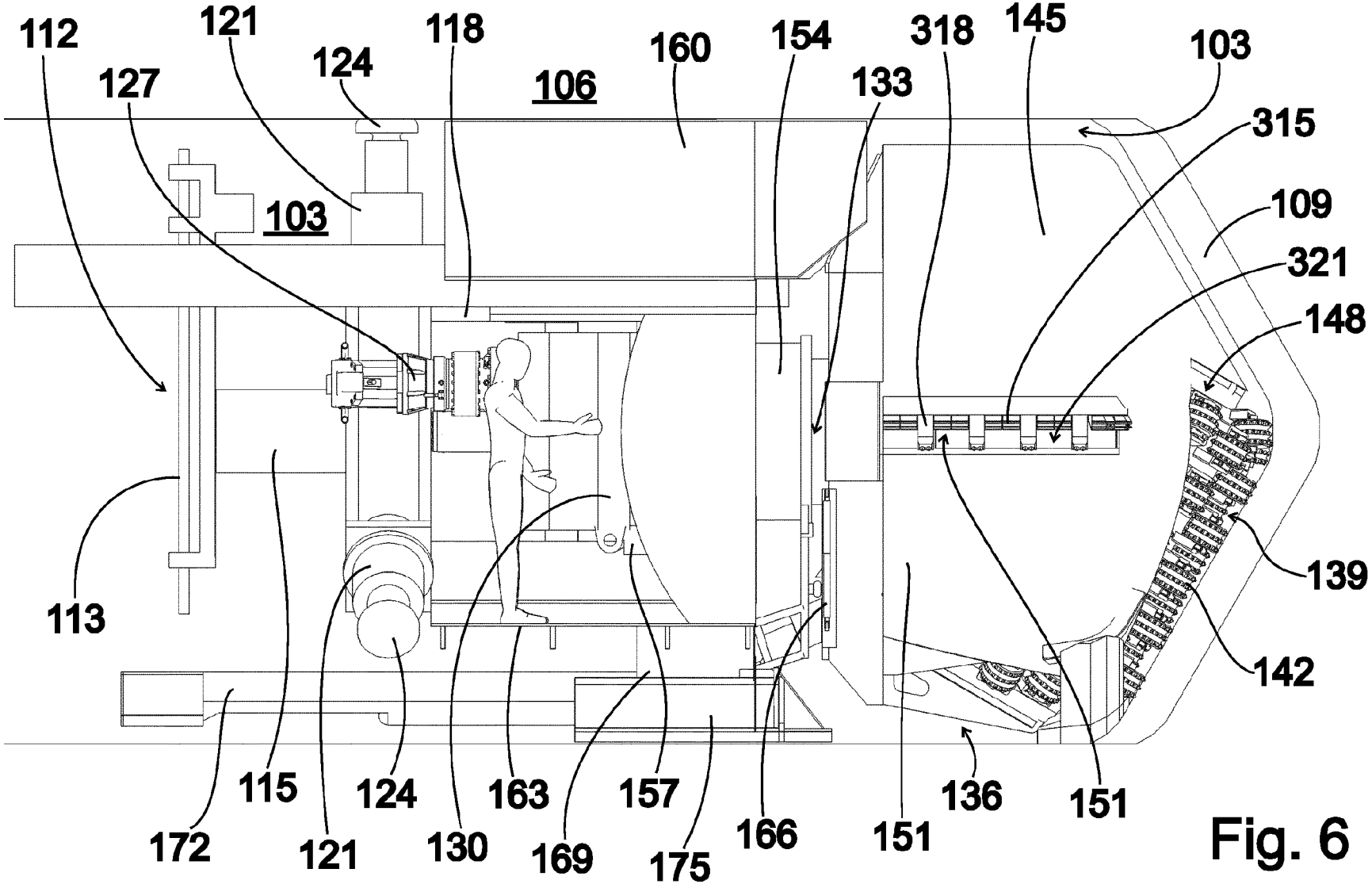
FIG. 6 is a side view, corresponding to FIG. 1, of the exemplary embodiment according to FIG. 1 with the extraction drum in an advancing position.

FIG. 6 shows a side view, corresponding to FIG. 1, of the exemplary embodiment according to FIG. 1, with the feed unit 154 in an advancing position that is shifted with respect to the starting position according to FIG. 1. The advancing position according to FIG. 6 is achieved, starting from the starting position according to FIG. 1, in that in the illustrated exemplary embodiment the feed cylinders 157 have become shorter compared to the starting position according to FIG. 1, so that the extraction drum 139 has moved away from the machine frame 118 in the direction of the working face 109.

A preferred method for operating a device according to the invention, in particular according to the exemplary embodiment explained with reference to FIGS. 1 through 6, is as follows.

In the starting position according to FIG. 1, at the start of an advancement cycle the extraction drum 139 rests against a working face 109, with the machine frame 118 braced via the pressed-on pressing plates 124. Starting from the starting position according to FIG. 1, the extraction drum 139 is set in rotation about the drum rotational axis 233, and after the start of this rotation, the feed unit 154 is moved in the direction of the longitudinal axis 218; from the starting position according to FIG. 1 into a partial advancing position with a partial axial lift as the axial lift. As a result, in a circumferential section the working face 109 is excavated, in the direction of the longitudinal axis 218, by the partial axial lift of the feed unit 154, which advantageously corresponds to an axial effective depth of the cutting rollers 142. The extraction drum 139 together with the feed unit 154 is subsequently rotated, by means of the rotary drive 130 and the axial shaft 133, at least one time about the longitudinal axis 218 by an angle of 360 degrees in the advancing position, with continuous rotation of the extraction drum 139 about the drum rotational axis 233, until, at the end of the advancement cycle, the entire surface of the working face 109 is excavated, compared to the start of the advancement cycle, by the partial axial lift of the feed unit 154.

During the rotation of the extraction drum 139 about the longitudinal axis 218 in one of the two rotational directions, excavation material removed from the working face 109 is predominantly conveyed via a conveying opening 151 into the excavation material receiving space 257, wherein at the end of an advancement cycle, the conveyed-in excavation material, when the closing slide 166 is situated in the area of the ejection chute 169, with the rotation about the longitudinal axis 218 at a standstill, is opened for emptying the excavation material receiving space 257 and discharging the removed excavation material via the discharge belt 172 [sic].

The volume of the excavation material receiving space 257 is advantageously configured in such a way that the excavation material receiving space 257, which in this exemplary embodiment is radially outwardly opened in the direction of the extraction drum 139 as well as via the conveying openings 151 and the conveying cutouts 321, is filled with removed excavation material during a partial axial lift when the extraction drum 139 rotates about the longitudinal axis 218, in such a way that a volume corresponding to the removed excavation material is emptiable.

After finalization of an advancement cycle, with excavation of the working face 109 by a length corresponding to the partial axial lift, a new advancement cycle begins, as described above, with rotation of the extraction drum 139 only about the drum rotational axis 233, and performance of a partial axial lift until the end of the new advancement cycle, as described above.

After carrying out a number of advancement cycles as described above until an overall axial lift, composed of the individual partial axial lifts and advantageously corresponding to an effective length of the feed unit 154, is reached, the starting position according to FIG. 1 is resumed at the end of the last advancement cycle, in that by shortening the feed cylinders 157 and pulling out the make-up cylinders 266, not illustrated in FIG. 6, the machine frame 118 is moved in the direction of the working face 109, the pressing plates 124 are released from the wall of the cavity 103, the bracing cylinder support 125 is moved toward the machine frame 118 by shortening the make-up cylinders 266, and the bracing cylinders 121 are once again extended.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A device for advancing a cavity in underground mining along in an advancing direction along a longitudinal axis, the device having an effective radius along a radial direction perpendicular to the longitudinal direction, comprising:

a rotary drive;

an axial shaft rotatable with the rotary drive about the longitudinal axis;

a single cylindrical extraction drum rotatable about a drum rotational axis, the extraction drum including a working face extending between opposite ends of the extraction drum, the working face having cutting rollers disposed at each of the opposite ends;

a connecting arrangement connected to the axial shaft and supporting the extraction drum with the drum rotational axis and the longitudinal axis disposed in a common plane and the drum rotational axis oriented at a fixed, acute angle with respect to the longitudinal axis in the advancing direction during advancement of the device in the advancing direction; and the extraction drum extending beyond the effective radius of the device in the radial direction during advancement of the device in the advancing direction.

2. The device of claim 1, further comprising a feed unit with which the axial shaft is movable between a starting position and an advancing position in the direction of the longitudinal axis.

3. The device of claim 1, wherein the connecting arrangement further comprises a connecting arm oriented at a right angle to the longitudinal axis.

4. The device of claim 3, wherein the connecting arm extends on first and second sides of the longitudinal axis.

5. The device of claim 3, further comprising drum retaining arms for retaining the extraction drum, the drum retaining arms mounted in end areas of the connecting arm, and wherein the drum retaining arms have different lengths in the direction of the longitudinal axis.

6. The device of claim 5, further comprising support arms oriented at right angles to the connecting arm, the support arms mounted on the connecting arm between the drum retaining arms.

7. The device of claim 6, further comprising protective plates mounted on the drum retaining arms and on the support arms.

8. The device of claim 1, wherein the connecting arrangement has an excavation material receiving space.

9. The device of claim 8, wherein the excavation material receiving space is radially outwardly open.

10. The device of claim 8, wherein the excavation material receiving space is operable and reclosable on a side thereof facing away from the extraction drum by means of a closure.

11. The device of claim 10, wherein in an operating position of the connecting arrangement, the closure is disposed proximate a discharging device for discharging removed excavation material.

12. The device of claim 1, wherein the cutting rollers are disposed over an entire extent of the working face between the opposite ends of the extraction drum.

13. A method for advancing a cavity in underground mining using the device of claim 1, comprising the steps of:

rotating the extraction drum only about the drum rotational axis while transferring the extraction drum from a starting position to an advancing position during an advancement cycle; and rotating the extraction drum about the longitudinal axis and about the drum rotational axis.

14. The method of claim 13, wherein the device further comprises a feed unit with which the axial shaft is movable between the starting position and the advancing position in the direction of the longitudinal axis, the method further comprising the additional step of:

rotating the drum about the drum rotational axis by at least 360 degrees.

15. The method of claim 14, further comprising displacing a machine frame of the device in the direction of the longitudinal axis.

16. A device for advancing a cavity in underground mining in an advancing direction along a longitudinal axis, the device having an effective radius along a radial direction perpendicular to the longitudinal direction, comprising:

a rotary drive;

an axial shaft rotatable with the rotary drive about the longitudinal axis;

a single extraction drum rotatable about a drum rotational axis;

a connecting arrangement connected to the axial shaft and supporting the extraction drum with the drum rotational axis and the longitudinal axis disposed in a common plane and the drum rotational axis oriented at an acute angle with respect to the longitudinal axis in the advancing direction during advancement of the device in the advancing direction; and the extraction drum extending beyond the effective radius of the device in the radial direction during advancement of the device in the advancing direction;

wherein the connecting arrangement has an excavation material receiving space operable and reclosable on a side thereof facing away from the extraction drum by means of a closure.

17. The device of claim 16, wherein in an operating position of the connecting arrangement, the closure is disposed proximate a discharging device for discharging removed excavation material.

18. A method for advancing a cavity in underground mining in an advancing direction along a longitudinal axis, the device having an effective radius along a radial direction perpendicular to the longitudinal direction comprising:

a rotary drive;

an axial shaft rotatable with the rotary drive about the longitudinal axis;

a single extraction drum rotatable about a drum rotational axis;

a connecting arrangement connected to the axial shaft and supporting the extraction drum with the drum rotational axis and the longitudinal axis disposed in a common plane and the drum rotational axis oriented at an acute angle with respect to the longitudinal axis in the advancing direction during advancement of the device in the advancing direction; and the extraction drum extending beyond the effective radius of the device in the radial direction during advancement of the device in the advancing direction, comprising the steps of:

rotating the extraction drum only about the drum rotational axis while transferring the extraction drum from a starting position to an advancing position during an advancement cycle; and rotating the extraction drum about the longitudinal axis and about the drum rotational axis.

19. The method of claim 18, wherein the device further comprises a feed unit with which the axial shaft is movable between the starting position and the advancing position in the direction of the longitudinal axis, the method further comprising the additional step of:

rotating the drum about the drum rotational axis by at least 360.

20. The method of claim 19, further comprising displacing a machine frame of the device in the direction of the longitudinal axis.

* * * * *